US007307499B2

(12) United States Patent
Nakamura et al.

(10) Patent No.: US 7,307,499 B2
(45) Date of Patent: Dec. 11, 2007

(54) HIGH-FREQUENCY RELAY

(75) Inventors: Masanori Nakamura, Kumamoto (JP); Mitsuhiro Kawai, Osaka (JP); Hiromi Shima, Osaka (JP); Kazumi Sako, Kumamoto (JP); Toshifumi Sumino, Osaka (JP)

(73) Assignee: OMRON Corporation, Kyoto (JP)

( * ) Notice: Subject to any disclaimer, the term of this patent is extended or adjusted under 35 U.S.C. 154(b) by 56 days.

(21) Appl. No.: 10/444,452

(22) Filed: May 23, 2003

(65) Prior Publication Data

US 2003/0218522 A1 Nov. 27, 2003

(30) Foreign Application Priority Data

May 23, 2002 (JP) ..... P.2002-149442

(51) Int. Cl.
*H01F 51/22* (2006.01)

(52) U.S. Cl. ..... 335/78; 335/83; 335/128

(58) Field of Classification Search ..... 335/78, 335/6, 86, 126, 128, 132
See application file for complete search history.

(56) References Cited

U.S. PATENT DOCUMENTS 4,625,191 A * 11/1986 Oberndorfer et al. ..... 335/78
5,015,978 A * 5/1991 Yokoo et al. ..... 335/78
6,608,542 B2 * 8/2003 Pietsch et al. ..... 335/274

FOREIGN PATENT DOCUMENTS

| | | |
|---|---|---|
| DE | 43 09 618 A1 | 9/1994 |
| DE | 44 08 980 A1 | 9/1994 |
| GB | 1 083 873 A | 9/1967 |
| JP | 2001-345036 | 12/2001 |

OTHER PUBLICATIONS

Patent Abstracts of Japan; Publication No. 2001–345036; Dec. 14, 2001, 1 pg.
European Search Report dated Feb. 22, 2005 (3 pages).

* cited by examiner

*Primary Examiner*—Tuyen T. Nguyen
(74) *Attorney, Agent, or Firm*—Osha Liang LLP

(57) ABSTRACT

A high-frequency relay includes: a base block having fixed terminals insert-molded to expose fixed contacts; an electromagnetic block mounted on the base block and for rotating a movable iron piece due to excitation and demagnetization; and movable blocks interlocking with a rotation operation of the movable iron piece so as to be connected with and disconnected from the fixed contacts of the base block. A push-in spring for pushing one of the movable blocks is provided in the movable iron piece. The push-in spring includes a fixed portion fixed to the movable iron piece, a pressure portion for applying pressure to the movable block, and foot portions each extending substantially perpendicularly to the movable block wherein extending directions of the foot portions cane be adjusted.

6 Claims, 11 Drawing Sheets

HIGH-FREQUENCY RELAY

BACKGROUND OF THE INVENTION

1. Field of the Invention

The present invention relates to a high-frequency relay suitable for switching a high-frequency signal.

2. Description of the Related Art

In the related art, there is disclosed a high-frequency relay in Japanese Patent Laid-Open No. 2001-345036. In this high-frequency relay, a contact block, a sub-base block, a hinge plate block, an armature block, and so on, are disposed on a base block. The contact block moves up and down within a space enclosed by the base block and the sub-base block so as to switch on/off a transmission line. The contact block itself is operated through the hinge plate block by rotating the armature block due to excitation and demagnetization of the electromagnetic block.

Some typical relays may have scattering in accuracy of parts and accuracy of assembling. Thus, desired operation properties cannot be obtained. In such a case, adjustment work is required after assembling.

In the related-art high-frequency relay, however, there is no way of performing adjustment except deformation of an armature spring fixed to the bottom surface of the armature. That is, the force to press the contact block through a hinge spring and a support member has to be adjusted only by picking up and deforming the portion of the armature spring protruding from the armature. In addition, the adjustable range may be limited only by such adjustment at one place, so that desired operation properties cannot be obtained. Thus, this results in the occurrence of defective products.

SUMMARY OF THE INVENTION

It is therefore an object of the invention to provide a high-frequency relay in which the work of adjustment after assembling is easy and the adjustable range is so wide that desired operation properties can be obtained without occurrence of defective products.

As means for solving the foregoing problem, the invention provides a high-frequency relay comprising:

a base block having a fixed terminal insert-molded to expose a fixed contact;

an electromagnetic block having a coil wound around an iron core through a spool, mounted on the base block and for rotating a movable iron piece due to excitation and demagnetization; and a movable block having a movable contact interlocking with a rotation operation of the movable iron piece so as to be connected with and disconnected from the fixed contact of the base block;

wherein the movable iron piece includes a push-in spring for pushing the movable block, the push-in spring having a fixed portion fixed to the movable iron piece, a pressure portion for applying pressure to the movable block, and a foot portion extending substantially perpendicularly to the movable block wherein an extending direction of the foot portion can be adjusted.

With this configuration, desired operation properties can be obtained easily only by deforming the foot portion of the push-in spring after assembling so as to change the extending direction of the foot portion with respect to the movable block. The angle of the foot portion with respect to the movable block can be changed easily and with a wide changeable range. Accordingly, the rate of occurrence of defective products can be reduced on a large scale.

A guide portions for guiding the foot portion of the push-in spring fixed to the movable iron piece may be formed in a side surface of the electromagnetic block.

Preferably, the electromagnetic block includes an adjustment portion continuous with the guide portion and capable of adjusting the extending direction of the foot portion of the push-in spring. In this case, the workability in the work of adjustment can be improved.

Further, the foot portion of the push-in spring may include a bent portion in a forward end portion thereof, and the bent portion is disposed in corresponding the guide portion of the electromagnetic block so that the foot portion can be elastically deformed by abutment of the bent portion against the guide portion when the movable iron piece rotates.

With this configuration, when the movable iron piece rotates, the foot portion can be elastically deformed over a wide range up to their bent portion in contact with the guide portion so as to apply a weak elastic force to the movable iron piece. As a result, even if the attraction of the electromagnetic block is not increased so much, the movable iron piece can be rotated smoothly. In addition, even if the elastic force of the return spring is weakened, the movable iron piece can be returned easily to its initial position through the movable block. Accordingly, the high-frequency relay can be arranged at a low price.

Preferably, the push-in spring includes an adjustment portion capable of adjusting a position of the pressure portion, the adjustment portion protruding from the movable iron piece. In this case, the high-frequency relay can be arranged to be easier to adjust.

Preferably, the electromagnetic block includes not only the guide portions but also a support recess portion capable of supporting a push-in spring of another type. In this case, parts can be standardized among relays of different types. Thus, the cost can be reduced.

DETAILED DESCRIPTION OF THE INVENTION

An embodiment of the invention will be described below with reference to the accompanying drawings.

Figure 1:
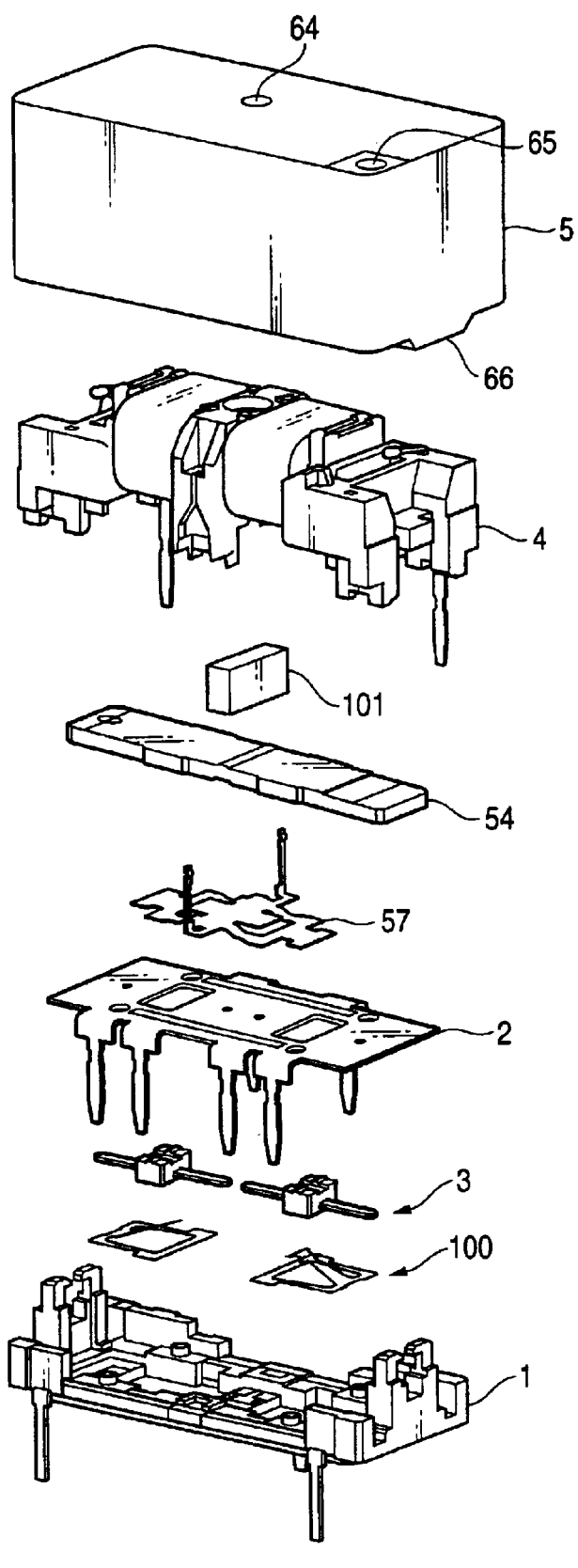
FIG. 1 is an exploded perspective view of a high-frequency relay according to an embodiment of the invention.
Figure 2A:
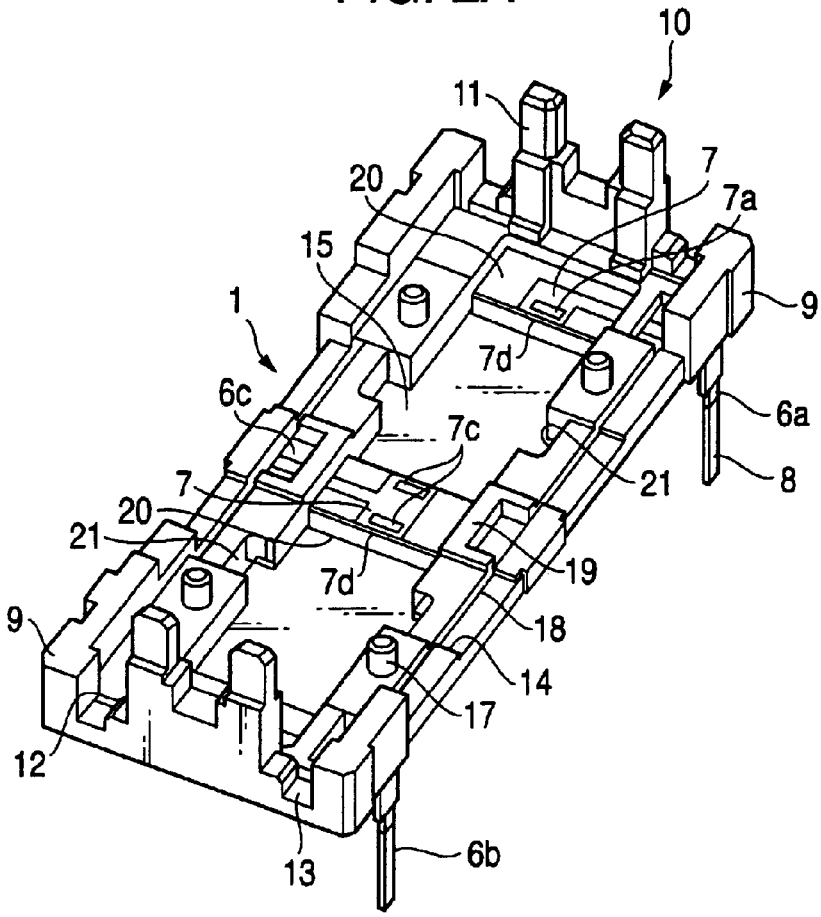
FIG. 2A is a perspective view of a base block shown in FIG. 1.
Figure 2B:
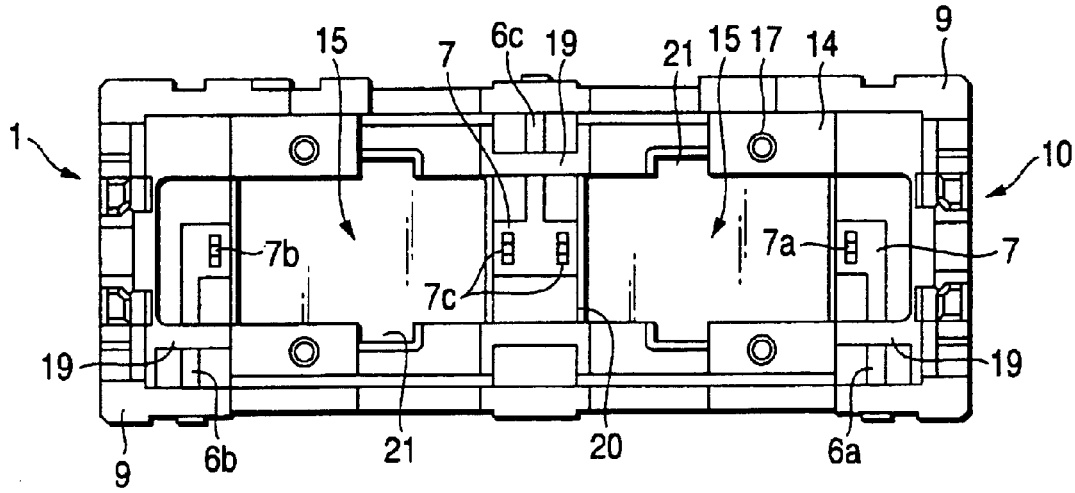
FIG. 2B is a plan view of the base block shown in FIG. 1.

FIG. 1 shows a high-frequency relay according to this embodiment. The high-frequency relay is mainly arranged as follows. That is, a ground plate 2, movable blocks 3 and an electromagnetic block 4 are mounted on a base block 1, and covered with a casing 5.

The base block 1 has a substantially rectangular plate-like shape as shown in FIGS. 2A–2B and FIGS. 3A–3C, which is obtained by insert-molding of fixed terminals 6*a*, 6*b* and 6*c*.

Each of the fixed terminals 6*a*, 6*b* and 6*c* is obtained by bending a conductive plate-like piece substantially at a right angle, and constituted by a fixed contact portion 7 and a foot portion 8. Two fixed contacts 7*c* are provided in the fixed contact portion 7 of the fixed terminal 6*c* (common terminal) disposed in the central portion of the base block 1. One fixed contact 7*a*, 7*b* is provided in the fixed contact portion 7 of the fixed terminal 6*a*, 6*b* (terminal a, b) disposed on either end portion of the base block 1.

Guide walls 9 are provided erectly on the top surfaces of the opposite end portions of the base block 1. In each of the guide walls 9 (end surface side), a substantially U-shaped retention portion 10 is formed so that an iron core 39 which will be described later can be fixed thereto by caulking narrow portions 11 on the top of the retention portion 10. Engagement recess portions 12 are formed on the opposite sides of the retention portion 10. Each engagement recess portion 12 has a retention recess portion 13 in its central portion. In addition, the inner and outer surfaces of each guide wall 9 (side surface side) are formed stepwise.

Recess portions 15 each surrounded by a protruding strip portion 14 are formed in the upper surface of the base block 1. The ground plate 2 is mounted on the protruding strip portion 14. The height of the protruding strip portion 14 is limited in a plurality of places so that air layers 16 (see FIG. 3B) can be formed between the protruding strip portion 14 and the ground plate 2 to be mounted thereon. In addition, projections 17 are formed at four places in the protruding strip portion 14 so as to serve to fix the ground plate 2. In addition, a seal groove 18 is formed in the protruding strip portion 14 so as to prevent seal agent from invading the inside at the time of sealing work which will be described later. In addition, bridging portions 19 are formed in the protruding strip portion 14 so as to prevent the thin fixed terminals 6*a*, 6*b* and 6*c* (the plate thickness used here is about 0.18 mm) from being deformed when the contacts are switched on/off. Each of the bridging portions 19 is made as narrow as possible but wide enough to allow resin to flow at the time of insert-molding. Thus, the bridging portions 19 are designed so that the fixed terminals 6*a*, 6*b* and 6*c* are prevented from floating when the contacts are switched on/off while the exposed area of each fixed terminal 6*a*, 6*b*, 6*c* is made maximal. The opposite end portions and the central portion of the recess portions 15 project upward so as to form seat portions 20. The fixed contact portions 7 of the fixed terminals 6 are exposed over the seat portions 20 respectively. In each seat portion 20, not only the top surface of the fixed contact portion 7 but also its edge portion 7*d* are exposed. In addition, lock guard portions 21 for positioning a return spring 100 are formed in each recess portion 15.

Figure 4:
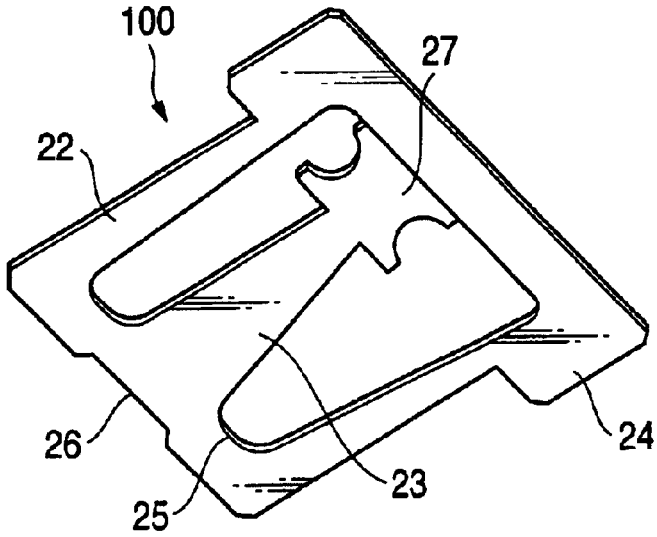
FIG. 4 is a perspective view of a return spring shown in FIG. 1.

In each return spring 100, an elastic tongue portion 23 is formed in a rectangular frame portion 22 by press working out of a plate-like spring material as shown in FIG. 4. Lock portions 24 are provided to extend from the opposite sides at one end of the rectangular frame portion 22. The base portion of the elastic tongue portion 23 is supported on the rectangular frame portion 22 through a bent portion 25, while the elastic tongue portion 23 is made easy to deform elastically due to the function of a depressed portion 26 formed in the rectangular frame portion 22. In addition, a displacement prevention stopper portion 27 is formed in the forward end of the elastic tongue piece 23. Each return spring 100 is disposed in the recess portion 15 of the base block 1 with the lock portions 24 being locked in the lock guard portions 21 of the base block 1. Thus, when the forward end of the elastic tongue piece 23 is pressed, the return spring 100 is elastically deformed not only in the elastic tongue piece 23 but also over a wide range from the base portion of the elastic tongue piece 23 to the lock portions 24 of the rectangular frame portion 22. Accordingly, a desired weak elastic force can be obtained in accordance with a predetermined displacement of the return spring 100 even in a narrow space limited within the recess portion 15 of the base block 1.

A part of each guide wall 9 extends to each side surface of the base block 1 as described above. At one side edge, the guide wall 9 sinks in all the area but the central portion and the opposite end portions thereof. At the other side edge, the guide wall 9 sinks at four places between the central portion and the opposite end portions. Then, a shield piece 33 of the ground plate 2 which will be described later is disposed in each sinking position.

Figure 3A:
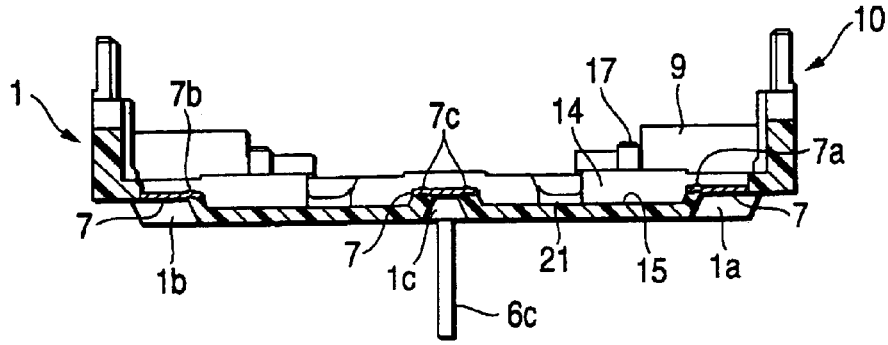
FIG. 3A is a sectional view of the base block shown in FIGS. 2A and 2B.
Figure 3B:
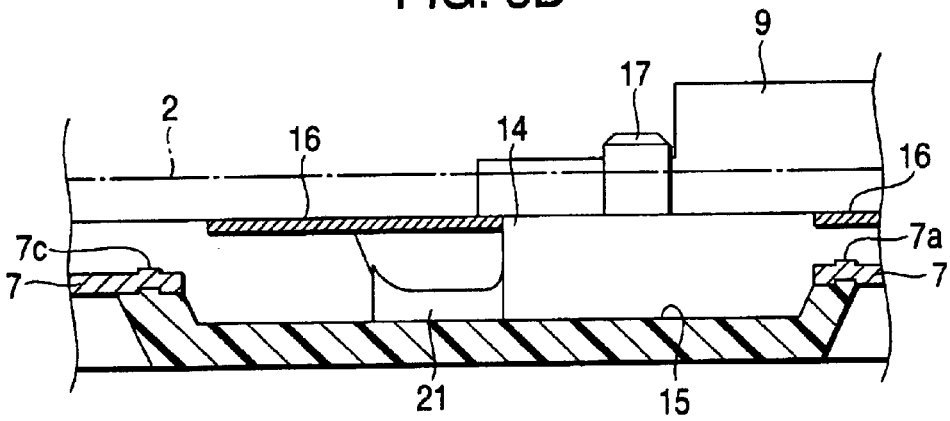
FIG. 3B is a partially enlarged view of FIG. 3A.
Figure 3C:
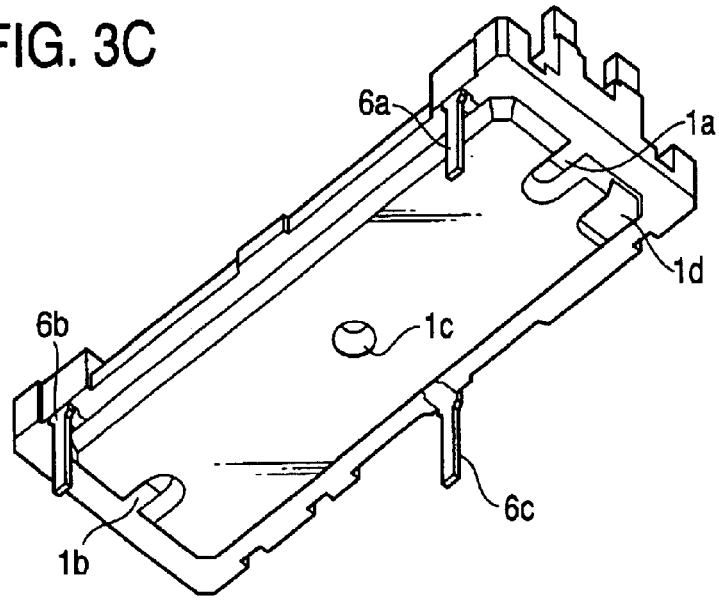
FIG. 3C is a perspective view of FIG. 3A from the bottom surface side.

In the bottom surface of the base block 1, as shown in FIG. 3C, the central portion and the outer edge portion thereof is cut off to reach a predetermined depth, and through holes 1*a*, 1*b* and 1*c* are formed to penetrate the centers of the seat portions 20 where the fixed contact portions 7 of the fixed terminals 6 should be placed, respectively. Thus, the fixed terminals 6 can be supported directly by a mold at the time of insert-molding, so that the fixed terminals 6 can be prevented from being displaced. Incidentally, a recess portion 1*d* is provided for a gate used for injection-molding of the base block 1 so that the mark of the gate is prevented from projecting over the bottom surface.

Figure 5:
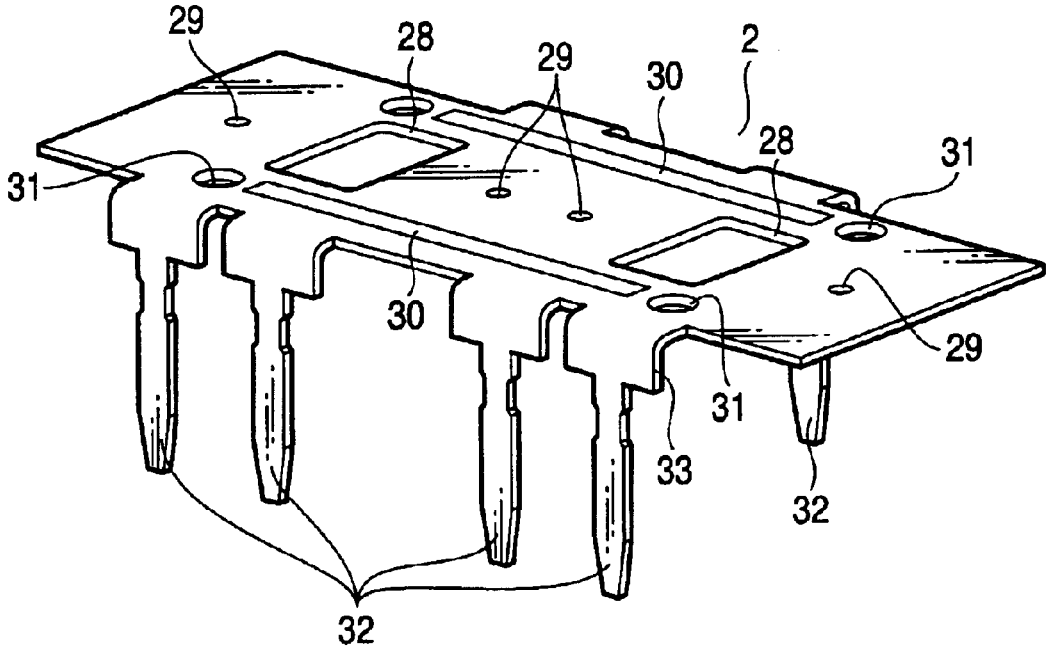
FIG. 5 is a perspective view of a ground plate shown in FIG. 1.

As shown in FIG. 5, the ground plate 2 is obtained by pressing working out of a conductive plate-like product and rectangular holes 28 are formed respectively on the opposite sides of the ground plate 2. Contact portions 29 are formed on the opposite sides of each rectangular hole 28 so as to project from the lower surface of the ground plate 2, respectively. Reinforcing ribs 30 are formed on the opposite side portions of the ground plate 2 so as to bulge upward respectively. Mounting holes 31 are formed near the opposite ends of each reinforcing rib 30. In addition, foot portions 32 are provided to extend from four places at one side edge of the ground plate 2 and from two places at the other side edge of the ground plate 2. A wide shield piece 33 is formed in the base portion of each foot portion 32.

Figure 6A:
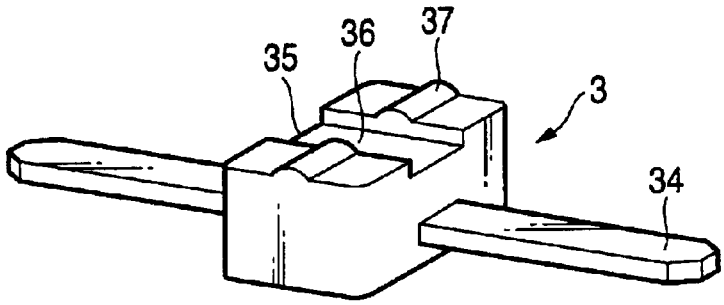
FIG. 6A is a perspective view of a movable block shown in FIG. 1.
Figure 6B:
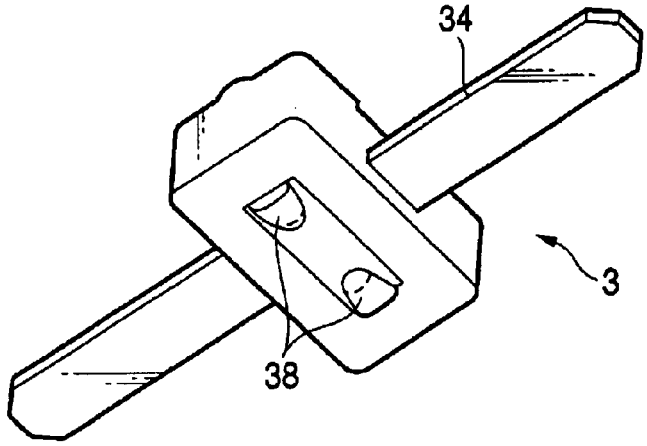
FIG. 6B is a perspective view of FIG. 6A from the bottom surface side.
Figure 6C:
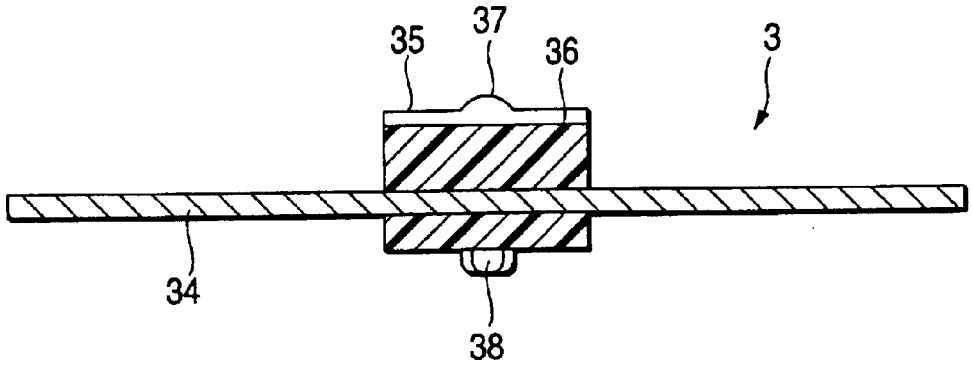
FIG. 6C is a sectional view of FIG. 6A.

In each movable block 3, as shown in FIGS. 6A–6C, a support portion 35 made of synthetic resin is integrated with a central portion of a movable contact piece 34 made of a conductive plate material. An escape groove 36 is formed in the central portion of the upper surface of the support portion 35 in the direction in which the movable contact piece 34 extends. A protruding strip 37 is formed in the central portion on each of opposite sides of the escape groove 36. The escape groove 36 is provided to prevent the mark of a not-shown gate from projecting over the upper surface of the support portion 35. A pair of protrusion portions 38 are formed in the lower surface of the support portion 35 so that the displacement prevention stopper portion 27 of the return spring 100 is locked. The movable block 3 moves up and down with the support portion 35 being disposed in the rectangular hole 28 of the ground plate 2. The opposite end portions of the movable contact piece 34 are brought into contact with the contact portions 29 of the ground plate 2 in the upper motion position where the movable block 3 is urged by the return spring 100. On the other hand, the opposite end portions of the movable contact piece 34 are closed on the fixed contacts 7*a* and 7*c* or 7*b* and 7*c* in the lower motion position.

Figure 7A:
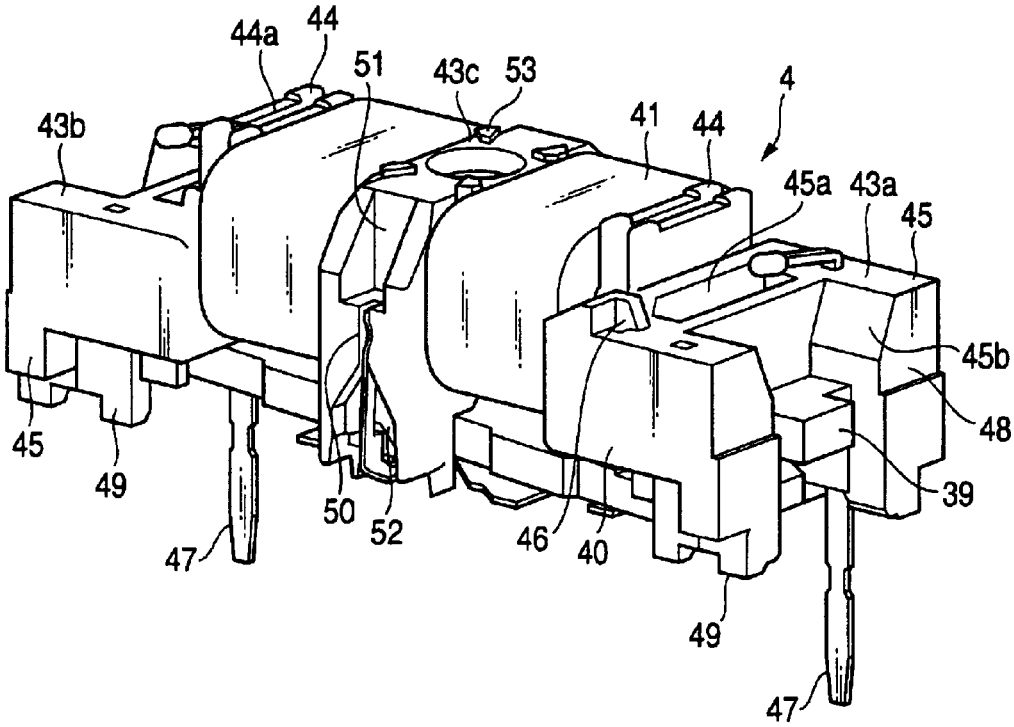
FIG. 7A is a perspective view of an electromagnetic block shown in FIG. 1.
Figure 7B:
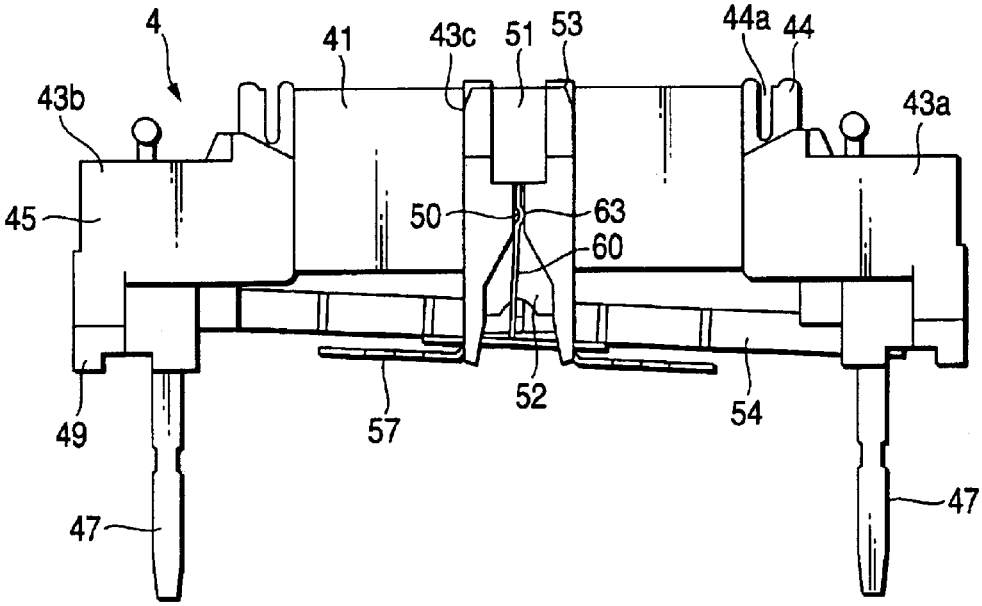
FIG. 7B is a front view of FIG. 7A.

In the electromagnetic block 4, as shown in FIGS. 7A and 7B, a coil 41 is wound around an iron core 39 through a spool 40. The iron core 39 is made from a magnetic plate material bent. The opposite end portions of the iron core 39 are positioned in the retention portions 10 of the base block 1, and the narrow portions 11 of the retention portions 10 are thermally caulked. Thus, the electromagnetic block 4 is fixed to the base block 1. The spool 40 is constituted by a chassis portion 42 (see FIG. 11) covering the intermediate portion of the iron core 39, and guide portions 43*a*, 43*b* and 43*c* formed in the opposite ends and the center of the chassis portion 42 respectively. Each of the guide portions 43*a* and 43*b* in the opposite ends is constituted by a collar portion 44 and a thick portion 45 provided to extend from the collar portion 44. A groove portion 44*a* is formed in the collar portion 44 so as to serve to guide the coil 41 when the coil 41 is wound by an automatic winding machine. A recess portion 45*a* is formed along the collar portion 44 in the thick portion 45, and an insulating wall 46 is formed in the vicinity of the recess portion 45*a*. A coil terminal 47 is pressed into the thick portion 45. The recess portion 45*a* serves to reduce the usage of resin and prevent the resin from being deformed after molding, and to chuck the coil 41 when the coil 41 is wound around the chassis portion 42. The insulating wall 46 insulates adjacent coil terminals 47 from each other (although one coil terminal 47 is pressed into each thick portion 45 in this embodiment, two coil terminals may be pressed into the thick portion 45 in another form, and on such an occasion, insulation of those coil terminals 47 from each other can be secured by the insulating wall 46). An escape portion 48 is formed in the end surface of each thick portion 45 so as to secure a space where resin can extend when the narrow portions 11 of the base block 1 are thermally caulked. In addition, one end portion of the iron core 39 is exposed between the opposite inner surfaces of each thick portion 45, and slopes 45*b* are formed in the upper portions of the opposite inner surfaces of the thick portion 45 so as to be estranged from each other gradually as they go upward. The slopes 45*b* are provided to increase the strength of a molding mold. Further, engagement protrusion portions 49 for engaging with the engagement recess portions 12 of the base block 1 are formed in the lower surfaces of the thick portions 45 respectively. Guide grooves 50 (0.3 mm wide here) extend vertically in the opposite side surfaces of the central guide portion 43*c*. An escape recess portion 51 is formed on the upper side of each guide groove 50, while an adjusting recess portion 52 is formed on the lower side of each guide groove 50. The recess portions 51 and 52 are provided for making it possible to work a mold for molding the narrow guide grooves 50. Particularly, the adjusting recess portion 52 also has a function for elastically deforming and adjusting a foot portion 60 of a push-in spring 57 which will be described later. In addition, guide protrusion portions 53 for laying the coil 41 between the pieces of the chassis portion 42 separated by the central guide portion 43*c* are formed at four places in the upper surface of the central guide portion 43*c*. Further, a recess portion 43*d* (see FIG. 11) is formed in the lower surface of the central guide portion 43*c*, and a permanent magnet 101 is disposed in the recess portion 43*d*. The permanent magnet 101 has different polarities in its upper and lower surfaces, and the upper surface thereof is in contact with the iron core 39. The coil 41 is wound on the coil terminal 47 whose one end portion is pressed into the guide portion 43*a*. The coil 41 is inserted into the groove portions 44*a* formed in the collar portions 44 so as to be oriented. After the coil 41 is wound around the chassis portion 42, the coil 41 is wound around the coil terminal 47 pressed into the guide portion 43*b*.

Figure 9A:
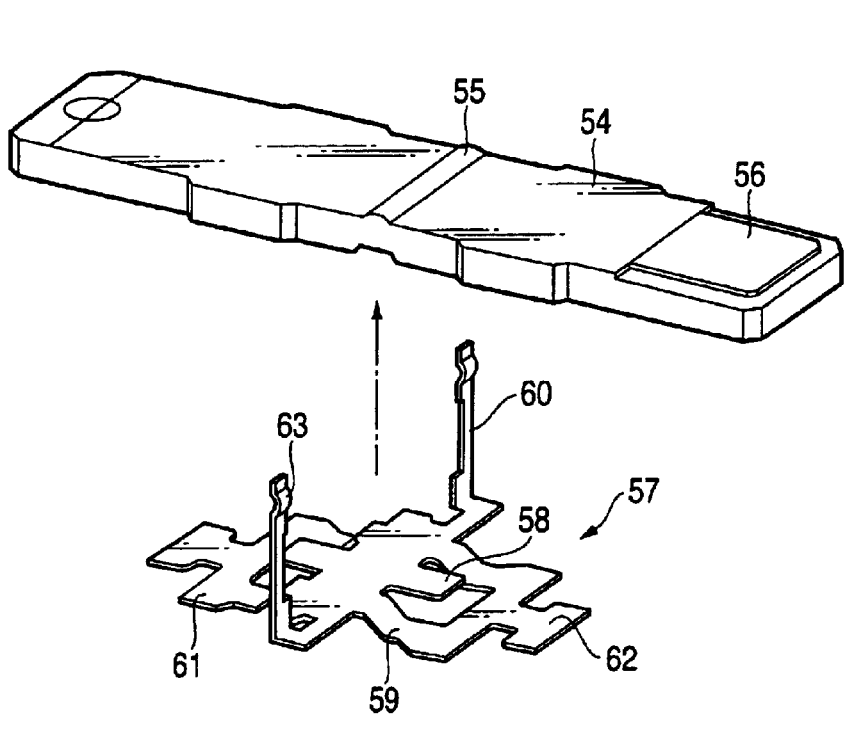
FIG. 9A is an exploded perspective view of the movable iron piece and the push-in spring.

A movable iron piece 54 is disposed rotatably under the electromagnetic block 4. As shown in FIG. 9A, the movable iron piece 54 is made from a magnetic plate material, and a protruding strip 55 is formed in the central portion of the movable iron piece 54 so as to extend widthwise. The protruding strip 55 is attracted to the lower surface of the permanent magnet 101 so as to allow the movable iron piece 54 to rotate around the protruding strip 55. In addition, a magnetic shield plate 56 made from a non-magnetic material such as stainless steel is pasted onto the upper surface on one end side of the movable iron piece 54. Thus, the movable iron piece 54 is off magnetic balance between its opposite end portions as the movable iron piece 54 is rotatably supported on the permanent magnet 101 of the electromagnetic block 4. Thus, the one end side (opposite to the magnetic shield plate 56) of the movable iron piece 54 is attracted to the iron core 39.

Figure 9B:
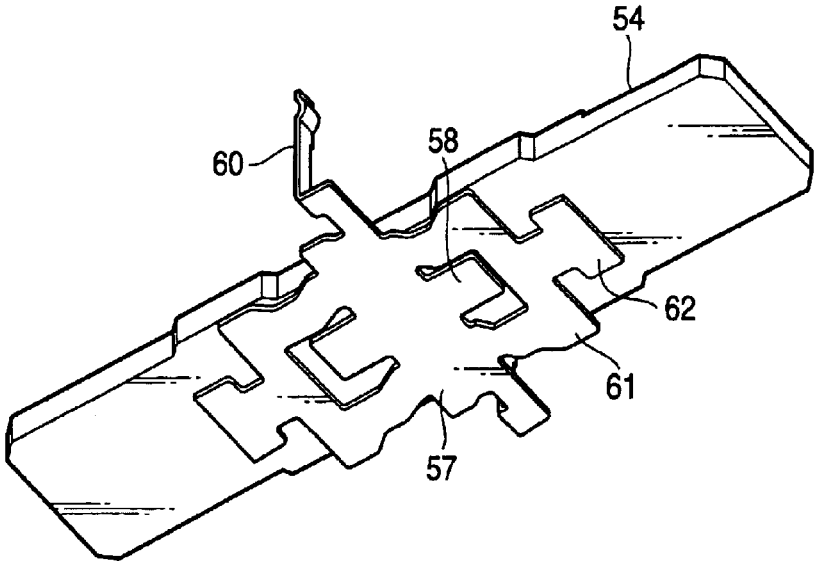
FIG. 9B is a perspective view from the bottom surface side, showing the state where the movable iron piece and the push-in spring have been installed.

The push-in spring 57 is fixed to the central portion of the lower surface of the movable iron piece 54. As shown in FIG. 9B, the push-in spring 57 is obtained by press working out of a magnetic plate material. The push-in spring 57 is constituted by a fixed portion 58 fixed to the movable iron piece 54, a drive portion 59 for driving the movable block 3, and foot portions 60 supported in the guide grooves 50 of the electromagnetic block 4. The fixed portion 58 has a rectangular shape to be fixed to the lower surface of the central portion of the movable iron piece 54 by spot welding or the like. The drive portion 59 has a frame-like shape extending from the central portion on each of opposite sides of the fixed portion 58, formed around the fixed portion 58 and bent downward stepwise. Adjustment portions 61 partially protruding from the movable iron piece 54 are formed on the opposite side portions of the drive portion 59. A pressure portion 62 for pressing the protruding strip 37 formed in the support portion 35 of the movable block 3 is provided in the central portion at the forward end of each adjustment portion 61. Each of the foot portions 60 is bent upward from the central portion on either side of the drive portion 59, so as to be located in the middle between the pressure portions 62. An arcuate bent portion 63 is formed at the tip of each foot portion 60. In addition, the foot portions 60 are guided by the guide grooves 50 formed in the central guide portion 43*c* of the electromagnetic block 4.

Figure 8D:
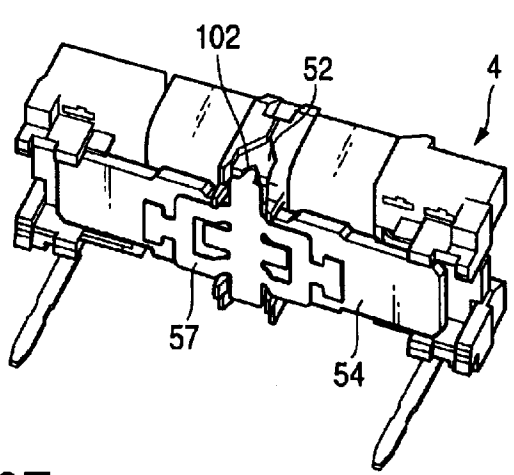
FIG. 8D is a perspective view from the bottom surface side, showing an electromagnetic block in which the movable iron piece and the push-in spring shown in FIG. 8B have been installed.
Figure 8E:
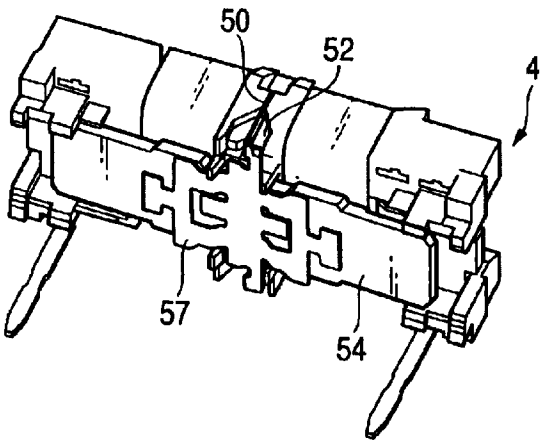
FIG. 8E is a perspective view from the bottom surface side, showing an electromagnetic block in which the movable iron piece and the push-in spring shown in FIG. 8C have been installed.
Figure 8A:
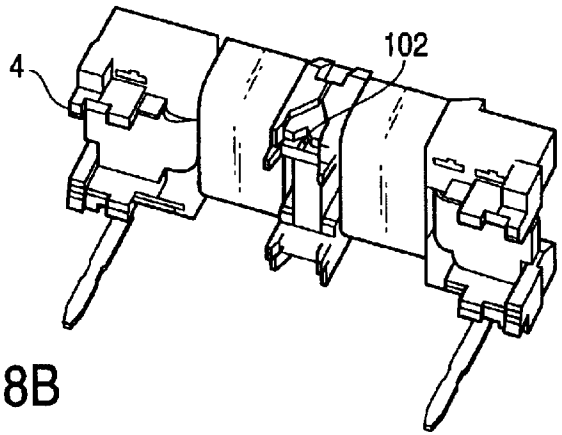
FIG. 8A is a perspective view from the bottom surface side, showing the electromagnetic block shown in FIG. 1.
Figure 8B:
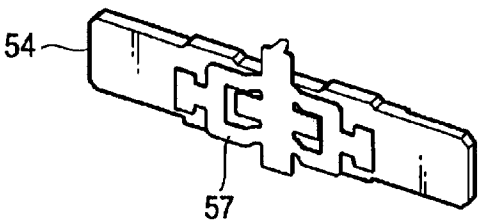
FIG. 8B is a perspective view from the bottom surface side, showing a movable iron piece and a push-in spring according to another embodiment of the invention.
Figure 8C:
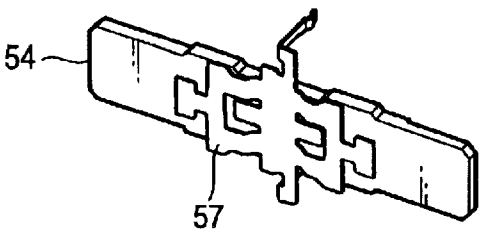
FIG. 8C is a perspective view from the bottom surface side, showing a movable iron piece and a push-in spring according to the embodiment of the invention.

Incidentally, the push-in spring 57 to be fixed to the movable iron piece 54 may be of a type having no foot portion 60, as shown in FIG. 8B. Even such a push-in spring 57 having no foot portion 60 can be also supported easily (see FIG. 8D) if a support recess portion 102 is formed as shown in FIG. 8A in the adjusting recess portion 52 in the electromagnetic block 4 having the aforementioned configuration.

As shown in FIG. 1, the casing 5 has a box-like shape whose lower surface is open, and a recess portion 64 for preventing the mark of the gate from projecting is formed in the central portion of the upper surface of the casing 5. A vent hole 65 is formed in a corner portion of the upper surface of the casing 5. In addition, in the edge portion of the opening in the lower surface of the casing 5, standoffs 66 are provided in the central portions of the opposite ends so as to form a predetermined gap between the bottom surface of the base block 1 and a not-shown printed board when the high-frequency relay is mounted on the printed board after the high-frequency relay has been assembled.

Next, description will be made on the method for assembling the high-frequency relay.

The return springs 100 are disposed in the recess portions 15 of the base block 1 in which the fixed terminals 6 have been insert-molded. Each return spring 100 is disposed to be biased to one side with respect to the fixed contacts 7*a* and 7*c* or 7*b* and 7*c* located in the opposite ends of the return spring 100 in the state where the lock portions 24 are locked in the lock guard portions 21. That is, an enough distance from the fixed contact portion 7 in the central portion is secured to guarantee the insulation performance.

Figure 10A:
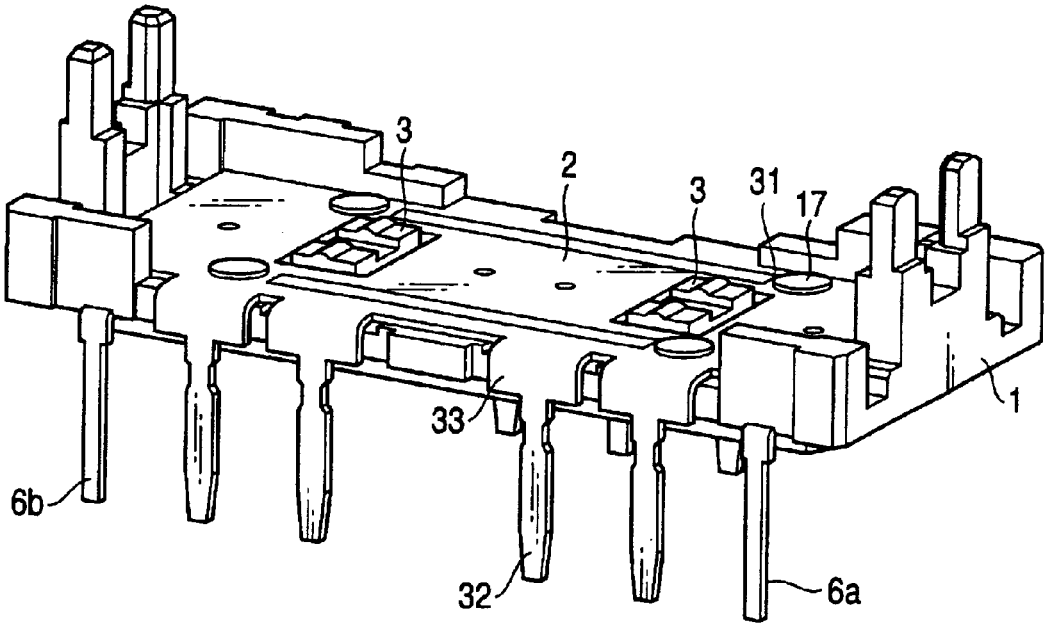
FIG. 10A is a perspective view showing the state where the movable blocks and the ground plate have been mounted on the base block.
Figure 10B:
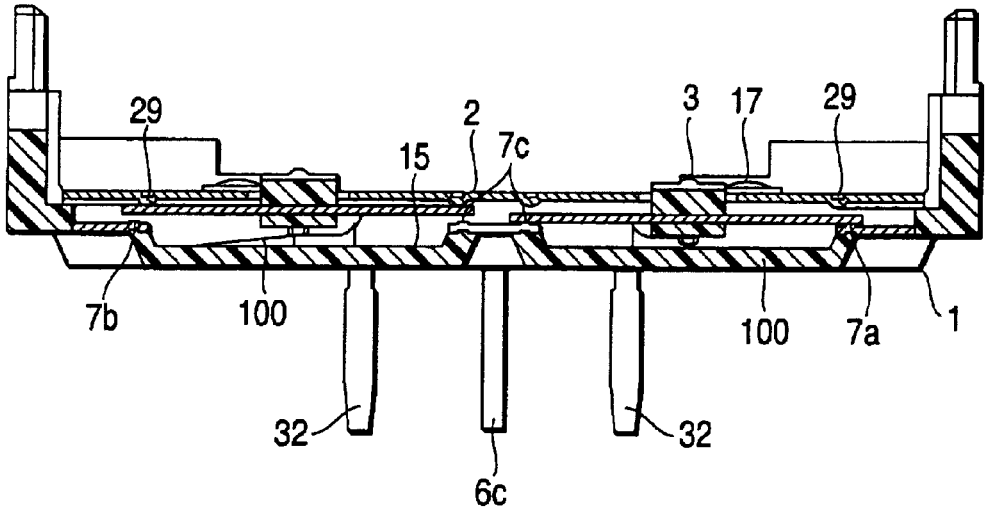
FIG. 10B is a sectional view of FIG. 10A.

Next, the movable blocks 3 and the ground plate 2 are mounted on the base block 1 sequentially. The projections 17 of the base block 1 inserted into the mounting holes 31 of the ground plate 2 are thermally caulked so that the ground plate 2 is fixed to the base block 1. In this state, as shown in FIGS. 10A and 10B, the displacement prevention stopper portion 27 formed in the elastic tongue piece 23 of each return spring 100 is engaged with the protrusion portions 38 of the support portion 35 while the side surfaces of the support portion 35 are guided by the rectangular holes 28 of the ground plate 2. Thus, each movable block 3 is urged upward in the state where the movable block 3 can be pushed in. As a result, the opposite end portions (movable contacts) of the movable contact piece 34 abut against the contact portions 29 of the ground plate 2.

On the other hand, the coil 41 is wound around the iron core 39 through the spool 40, and the permanent magnet 101 is disposed in the recess portion 43*d*. Thus, the electromagnetic block 4 is formed. Then, the push-in spring 57 is integrated with the central portion of the lower surface of the movable iron piece 54 and the foot portions 60 of the push-in spring 57 are inserted into the guide grooves 50 of the electromagnetic block 4 while the protruding strip 55 of the movable iron piece 54 is attracted to the lower surface of the permanent magnet 101. Thus, the movable iron piece 54 is disposed rotatably under the electromagnetic block 4. In this state, the movable iron piece 54 is off magnetic balance due to the magnetic shield plate 56 pasted to one end portion of the movable iron piece 54. Accordingly, the movable iron piece 54 rotates clockwise in FIG. 11 in accordance with the attraction of the permanent magnet 101.

Next, the electromagnetic block 4 provided with the movable iron piece 54 and the push-in spring 57 is mounted on the base block 1 mounted with the return springs 100, the movable blocks 3 and the ground plate 2. The engagement protrusion portions 49 formed in the guide portions 43*a* and 43*b* of the electromagnetic block 4 respectively are engaged with the engagement recess portions 12 of the base block 1 respectively, and the narrow portions 11 are thermally caulked to retain the iron core 39. Thus, the electromagnetic block 4 is integrated with the base block 1. As a result, the switching between the opposite end portions (movable contacts) of the movable contact piece 34 and the fixed contacts 7*a* and 7*c* or 7*b* and 7*c* of the fixed terminals 6 is located within the recess portion 15 surrounded by the ground plate 2. The shield pieces 33 extending downward are formed at the side edges of the ground plate 2. In addition, the air layer 16 is formed partially between the ground plate 2 and the protruding strip portion 14 forming the recess portions 15. Accordingly, the insulation performance in the contact on/off portion is so high that a high-frequency signal can be transmitted suitably. In addition, the sides of the area where the movable block 3 is pressed by the push-in spring 57 due to rotation of the movable iron piece 54 are opened.

In this state, a current is once applied to the coil 41 through the coil terminals 47 so as to excite and demagnetize the electromagnetic block 4. Then, the condition of a signal conducted between the fixed terminals 6*a* and 6*c* or 6*b* and 6*c*, that is, the operating characteristic such as the on-off timing of the contacts or the contact pressure is examined. Thus, it can be judged whether the movable iron piece 54 rotates suitably or not. When the operating condition is not suitable, the push-in spring 57 is deformed for adjustment. Here, first, the adjustment portion 61 protruding widthwise relatively to the movable iron piece 54 is grasped directly from its sides, and deformed. When a desired operating condition cannot be obtained by the adjusting work using the adjustment portion 61, another adjusting work is performed by grasping and deforming the foot portions 60 through the adjusting recess portions 52 formed in the side surfaces of the electromagnetic block 4 to thereby change an angle of the foot portion 60 with respect to the movable block 34. Thus, desired operating properties can be obtained surely.

When the adjusting work is completed thus, the base block 1 is covered with the casing 5, and the mating face in the bottom surface of the casing 5 is sealed. In the sealing work, seal agent may invade the inside. However, since the seal groove 18 is formed in the base block 1, there is no fear that the seal agent reaches the drive parts of the movable blocks 3, the fixed contact portions 7, or the like.

Next, description will be made on the operation of the high-frequency relay.

The high-frequency relay formed as described above is in use mounted on a printed board (not-shown) having a ground pattern formed therein. As a result, the contact on-off mechanism can be placed within an area enclosed by the ground plate 2 and the ground pattern of the printed board. Thus, the insulation performance can be enhanced further.

The movable iron piece 54 is off magnetic balance due to the magnetic shield plate 56 before a voltage is applied between the coil terminals 47. Thus, the movable iron piece 54 rotates clockwise around the protruding strip 55 in FIG. 11 in accordance with the magnetic force of the permanent magnet 101. Accordingly, one of the movable blocks 3 is pushed down by the pressure portion 62 of the push-in spring 57 so that the opposite end portions (movable contacts) of its movable contact piece 34 are closed on the fixed contacts 7*a* and 7*c* respectively. Thus, continuity is secured between the fixed terminals 6*a* and 6*c*. The other movable block 3 is pushed up by the return spring 100 so that the opposite end portions (movable contacts) of its movable contact piece 34 are brought into contact with the contact portions 29 of the ground plate 2 (initial position).

Here, when a voltage is applied between the coil terminals 47 so as to excite the electromagnetic block 4, the movable iron piece 54 is attracted thereto in its end portion distant from the iron core 39. Thus, the movable iron piece 54 rotates counterclockwise around the protruding strip 55 in FIG. 11. When the movable iron piece 54 is rotating, the movable iron piece 54 receives only a weak elastic force caused by elastic deformation in the foot portions 60 of the push-in spring 57 fixed to the lower surface of the movable iron piece 54, particularly in a wide range reaching the bent portions 63 at the tips of the foot portions 60 in contact with the side surfaces forming the guide grooves 50. Thus, the movable iron piece 54 rotates smoothly. With this rotation, the push-in spring 57 pushes down the movable block 3 against the urging force of the return spring 100. The push-in spring 57 and the return spring 100 are disposed in substantially symmetrical positions with respect to the contact on-off position so as to cancel components other than vertical components, that is, horizontal components. Thus, most of force acting on the movable block 3 works only vertically. In addition, the return spring 100 elastically deforms not only the elastic tongue piece 23 but also a part of the rectangular frame. Therefore, the return spring 100 is displaced even by push-in force not so strong. Thus, the movable block 3 moves down smoothly so as to close the opposite end portions (movable contacts) of the movable contact piece 34 with the fixed contacts 7*b* and 7*c* respectively, and thereby make continuity between the fixed terminals 6*b* and 6*c*. Not only is the upper surface of each fixed contact portion 7 exposed, but the edge portion thereof is also exposed due to the existence of the seat portion 20. Thus, the contact area with the air increases. As a result, the insulation performance is so high that it is difficult to leak any signal.

On the other hand, the movable block 3 released from the push-in force by the rotation of the movable iron piece 54 moves up due to the elastic force of the return spring 100 so as to separate the opposite end portions (movable contacts) of the movable contact piece from the fixed contacts 7*a* and 7*c* respectively, and thereby break the continuity between the fixed terminals 6*a* and 6*c*. Then, the opposite end portions of the movable contact piece 34 of the movable block 3 moving up are brought into contact with the contact portions 29 of the ground plate 2 so as to be grounded. Thus, any high-frequency signal is surely prevented from leaking.

Figure 11:
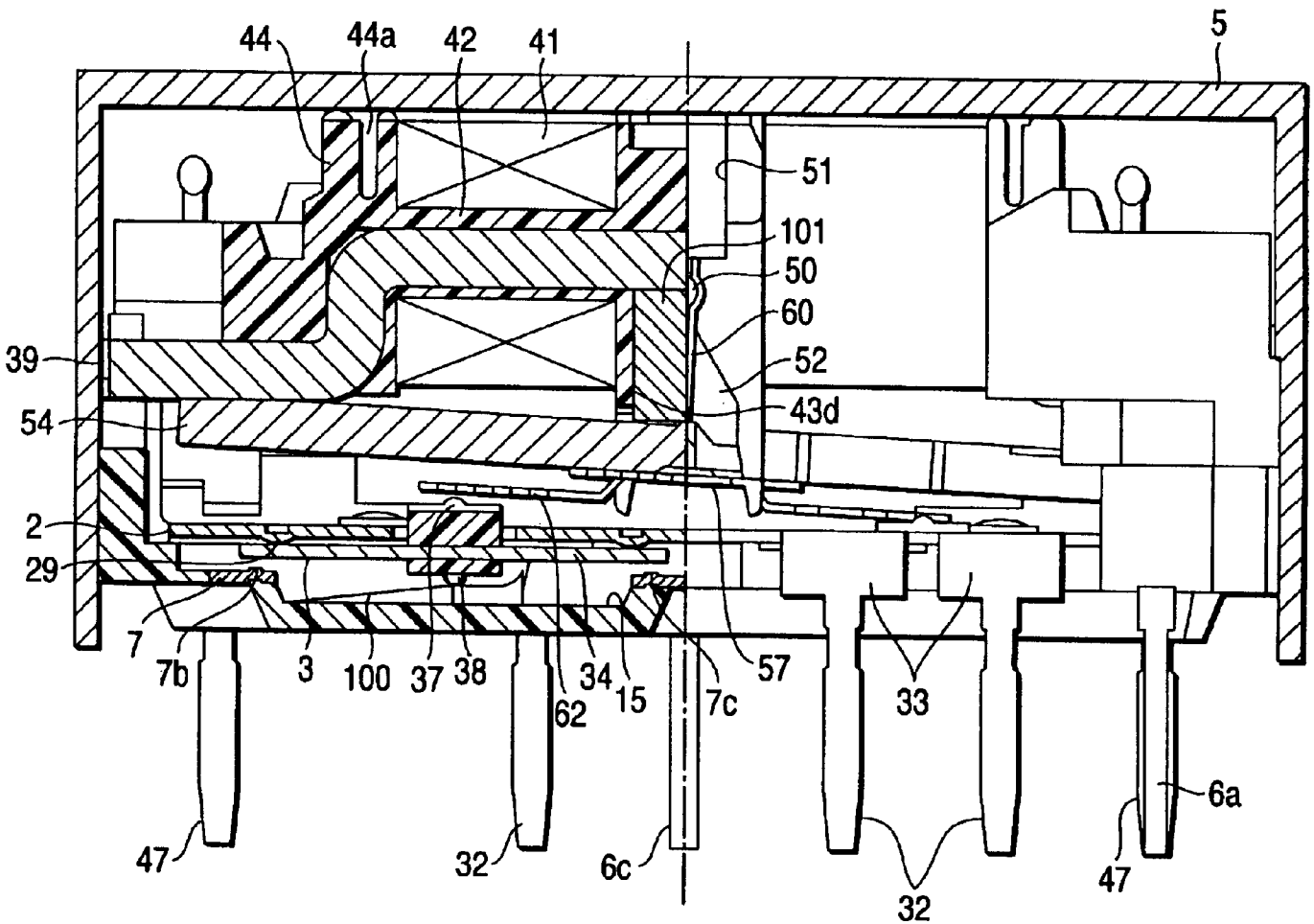
FIG. 11 is a sectional view of the high-frequency relay according to this embodiment.
Figure 12:
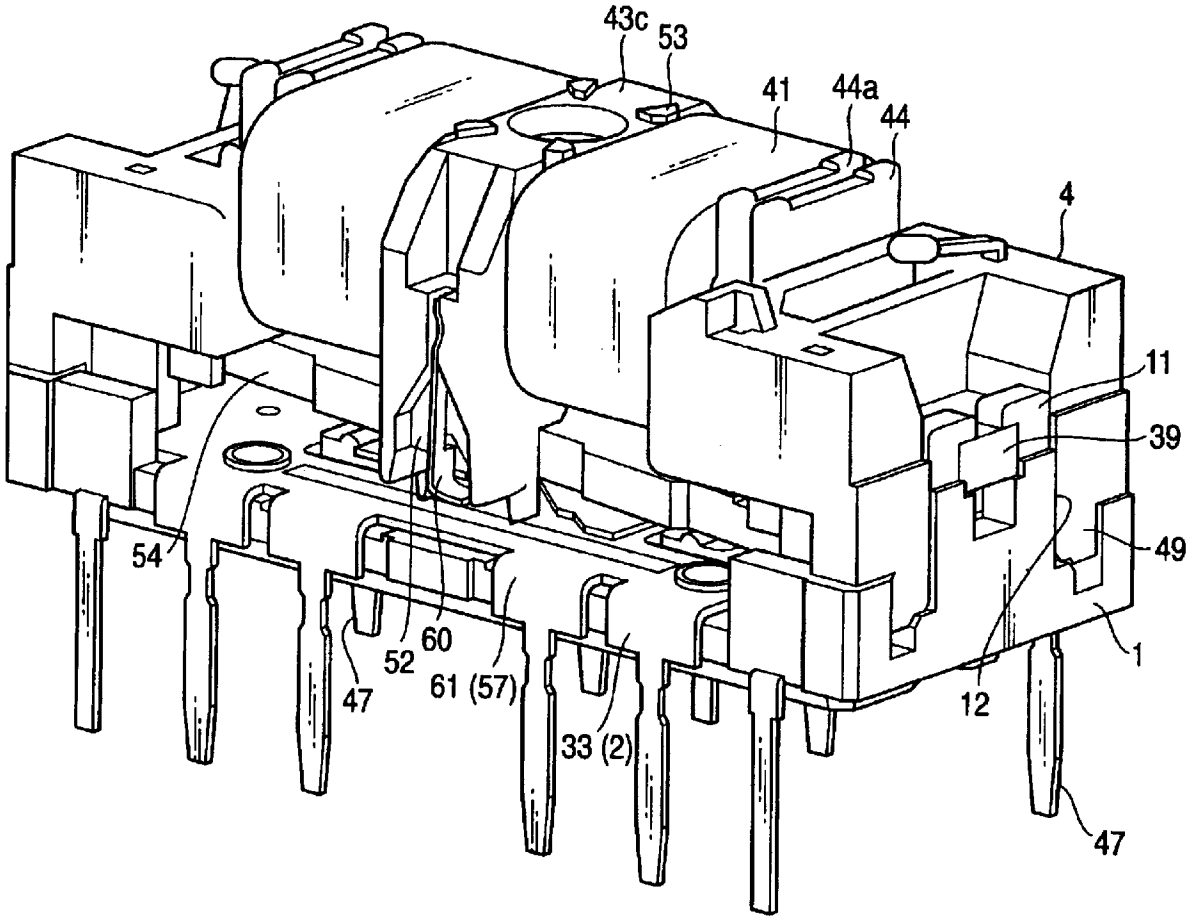
FIG. 12 is a perspective view showing the state where a casing has not yet been installed in the high-frequency relay according to the embodiment.

When the voltage applied between the coil terminals 47 is eliminated, the movable iron piece 54 rotates clockwise in FIG. 11 in accordance with the elastic force of the push-in spring 57, the elastic force of the return spring 100, the magnetic force of the permanent magnet 101 weakened on only one end side of the movable iron piece 54 due to the magnetic shield plate 56, and the like. Thus, the movable iron piece 54 returns to the initial position.

Incidentally, description in this embodiment has been made on a so-called self-reset type relay in which the magnetic shield plate 56 is provided in the movable iron piece 54 so as to change over the contact on-off position between the case where a current is applied to the coil 41 and the case where no current is applied thereto. However, the invention may be configured as follows. That is, the invention may be applied to a so-called self-holding type relay in which the magnetic shield plate 56 is not provided, but the direction in which a current is applied to the coil 41 is changed to thereby change the polarities in the end portions of the iron core 39 so as to change over the contact on-off position. Alternatively, coil terminals 47 may be provided at three places. In this case, one of the coil terminals 47 is used as a common coil terminal, and two coils different in winding direction are provided. The winding direction of a coil connecting the common coil terminal with one of the rest two coil terminals is made different from the winding direction of a coil connecting the common coil terminal with the other. Thus, a current is applied between the common coil terminal and a selected one of the coil terminals so that the movable iron piece 54 can rotate.

As is apparent from the above description, according to the invention, a push-in spring provided in a movable iron piece is designed to include foot portions each extending substantially perpendicularly to a movable block wherein an extending direction of the foot portion can be adjusted. Thus, only by deforming each foot portion to thereby change the angle of the foot portion with respect to the movable block, the elastic force acting on the movable iron piece can be adjusted easily so that the rate of occurrence of defective products can be reduced while desired operation properties can be obtained easily.

What is claimed is:

1. A high-frequency relay comprising:

a base block having a fixed terminal insert-molded to expose a fixed contact;

an electromagnetic block having a coil wound around an iron core through a spool, mounted on said base block and for rotating a movable iron piece due to excitation and demagnetization; and a movable block having a movable contact interlocking with a rotation operation of said movable iron piece so as to be connected with and disconnected from said fixed contact of said base block;

wherein said movable iron piece includes a push-in spring for pushing said movable block, said push-in spring having a fixed portion fixed to said movable iron piece, a pressure portion for applying pressure to said movable block, and a foot portion extending substantially perpendicularly to said movable block wherein an extending direction of the foot portion can be adjusted.

2. A high-frequency relay according to claim 1, wherein said electromagnetic block includes a guide portion for guiding said foot portion of said push-in spring fixed to said movable iron piece, said guide portion being provided in a side surface of said electromagnetic block.

3. A high-frequency relay according to claim 2, wherein said electromagnetic block includes an adjustment portion continuous with said guide portion and capable of adjusting said extending direction of said foot portion of said push-in spring.

4. A high-frequency relay according to claim 2, wherein said foot portion of said push-in spring includes a bent portion in a forward end portion thereof, said bent-portion being disposed in corresponding said guide portion of said electromagnetic block, said foot portion being elastically deformed by abutment of said bent portion against said guide portion when said movable iron piece rotates.

5. A high-frequency relay according to claim 1, where-in said push-in spring includes an adjustment portion capable of adjusting a position of said pressure portion, said adjustment portion protruding from said movable iron piece.

6. A high-frequency relay according to claim 1, wherein said electromagnetic block includes a guide portion for guiding said foot portion of said push-in spring fixed to said movable iron piece and a support recess portion capable of supporting a push-in spring of another type.

* * * * *